US005323794A

United States Patent [19]

Favre

[11] Patent Number: 5,323,794

[45] Date of Patent: Jun. 28, 1994

[54] INTERCHANGEABLE COMPACT

[75] Inventor: Bernard Favre, Chevilly-Larue, France

[73] Assignee: LIR France, Chevilly-Larue, France

[21] Appl. No.: 45,237

[22] Filed: Apr. 12, 1993

[30] Foreign Application Priority Data

Apr. 21, 1992 [FR] France ..... 92 04846

[51] Int. Cl.[5] ..... A45D 33/24

[52] U.S. Cl. ..... 132/294; 132/293

[58] Field of Search ..... 132/293, 294, 295, 296, 132/300, 314, 315; 206/581, 823

[56] References Cited

U.S. PATENT DOCUMENTS

| | | | |
|---|---|---|---|
| 1,883,793 | 10/1932 | Johnson | 132/300 |
| 4,421,127 | 12/1983 | Geer | 132/294 |
| 4,538,725 | 9/1985 | Glover et al. | 132/294 |
| 4,589,430 | 5/1986 | Sussman | 132/294 |
| 4,821,751 | 4/1989 | Chen | 132/295 |
| 4,826,014 | 5/1989 | Schefer | 132/294 |
| 4,863,034 | 9/1989 | Contreras, Sr. | 132/294 |
| 5,092,354 | 3/1992 | Pacelli, Jr. | 132/294 |
| 5,199,451 | 4/1993 | Montoli | 132/294 |

*Primary Examiner*—Gene Mancene
*Assistant Examiner*—Frank A. LaViola
*Attorney, Agent, or Firm*—Young & Thompson

[57] ABSTRACT

The invention relates to a compact of the type comprising a base (1) and a cover (2) articulated to each other by a hinge (3), catch (10, 11) of the base (1) relative to the cover (2) opposite the hinge (3), and an interchangeable pan (4) containing at least one makeup product (5) and disposed in the base (1). The compact according to the invention is open over a portion of its front surface opposite the hinge (3), and the pan (4) comprises a portion (8), of a different shape for a compact of predetermined type relative to a compact of another type, comprising a projection outside the compact through the opening of the forward surface of the compact.

4 Claims, 1 Drawing Sheet

INTERCHANGEABLE COMPACT

The present invention relates to a compact of the type comprising a base and a cover articulated to each other by means of a hinge, catch means for the base and cover opposite the hinge, and an interchangeable pan containing at least one makeup product and disposed in said base.

Compacts of this type have received very widespread use for various types of makeup in the form of pressed powder cakes. The interchangeable pan permits, after use of the products, replacing the used pan by a new pan, which reduces for the user the price of the packaging.

These known compacts have, within the same range, different shapes which give rise to increased packaging costs which of course reflect on the sale price. Moreover, a compact for one particular application cannot be used and reloaded except for this use.

The present invention aims to provide a new compact which permits, with the same basic compact, different uses and shapes by a simple changing of the pan.

To this end, the compact according to the invention is characterized in that it is open over a portion of its forward surface opposite said hinge, and said pan comprises a portion of a different shape for a predetermined type of compact relative to a compact of another type, in the form of a projection outside the compact through said opening of the forward surface of the compact.

This projecting portion of variable shape permits modifying the appearance of the compact according to the pan which is used with it, without supplemental machining costs for the compact itself, the machining of the pan being practically of the same cost when they have no external projection as in the prior art and when they have such a projection according to the invention.

According to a preferred embodiment of the invention, said projection comprises an elastic nose for clamping to the edge of the base. Preferably, said projection also has a nose for clamping with the cover.

Of course, it is possible to keep a direct clamping of the cover to the base with respective clamping members passing through an opening provided in the projection of the pan.

The invention will be understood from the reading of the following description given with reference to the accompanying drawing, in which.

Figures 1, 2, 3, 4, 5, 6, 7, 8:
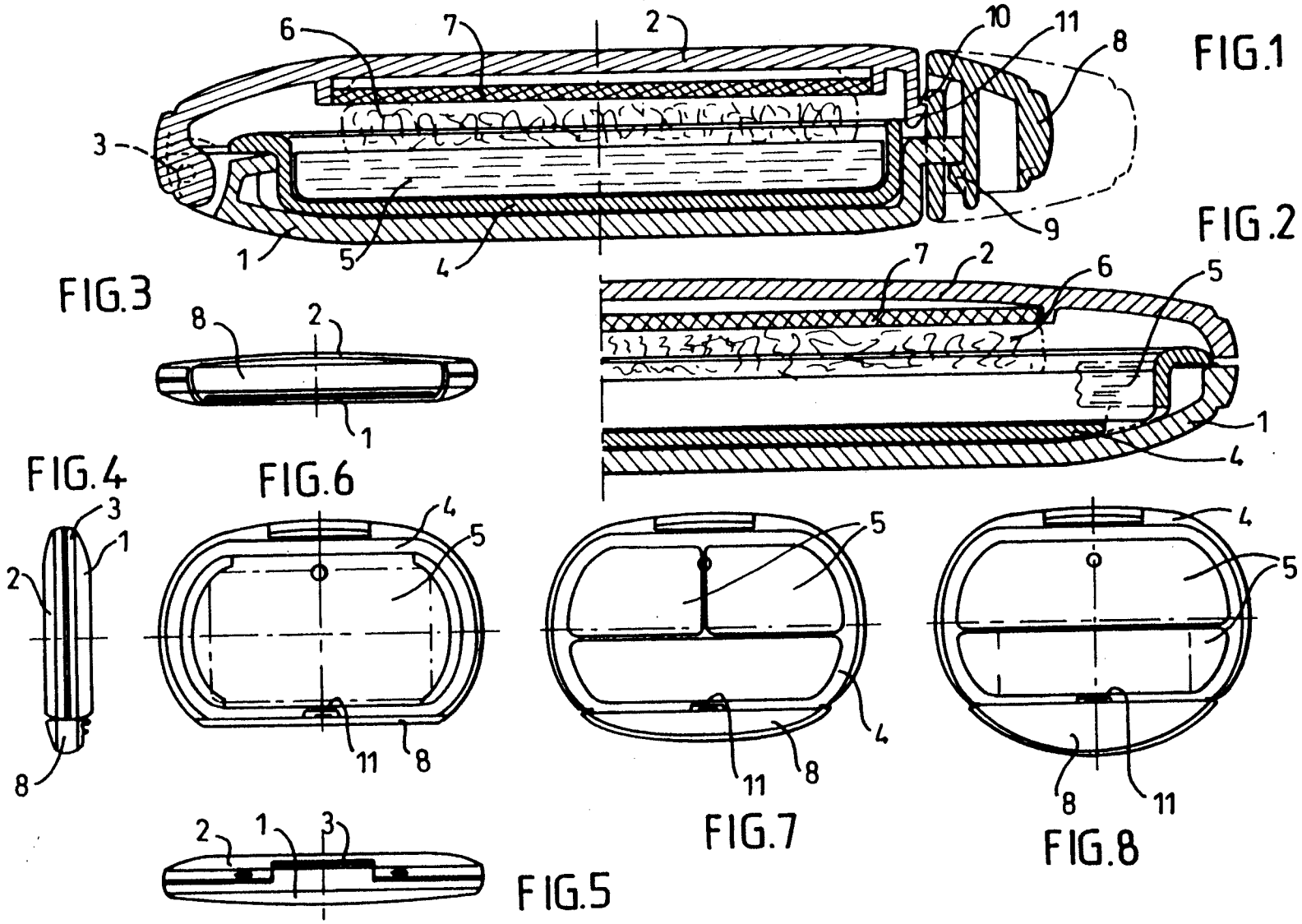
FIG. 1 is a cross sectional view transversely to the articulation, of a compact according to an embodiment of the invention, provided with a first pan.
FIG. 2 is a half cross section of the compact of FIG. 1 on the line II—II of FIG. 1.
FIG. 3 is a front elevational view of the compact of FIGS. 1 and 2.
FIG. 4 is a side elevational view of the compact of FIGS. 1 to 3.
FIG. 5 is a rear elevational view of the compact of FIGS. 1 to 4.
FIGS. 6 to 8 are plan views of various pans usable in the compact of FIGS. 1-5.

The compact according to the invention comprises a base 1 and a cover 2 articulated on the base 1 by means of an axle of articulation 3. A pan 4 containing one or several cakes 5 of pressed powder is disposed within the base 1. A powder puff 6 is gripped between the cakes 5 and a member 7 fixed to the interior of the cover 2.

According to the present invention, the assembly constituted by the base 1 and the cover 2 has a frontal opening through which passes an external projection 8 of the pan 4. The projection 8 can be of oval shape, as indicated in full line in FIG. 1 and.in FIG. 7, of flattened shape (FIG. 6) or in the form of an arc of a circle (in mixed lines in FIG. 1 and in FIG. 6). Of course, numerous other shapes of the projection 8 can be envisaged. The internal portion of the pan 4 can be adapted to receive one or several cakes 5, particularly as a function of the shape of the projection 8. One could thus, with the same assembly of base 1 and cover 2, create a multiplicity of compacts having different shape and/or function. The corresponding costs of machining are greatly reduced relative to the prior art, which requires a cover mold and a base mold for each shape of compact, and a pan mold for each use for each given shape of compact.

In the embodiment illustrated, it is moreover provided that the projection 8 of the pan 4 comprises a resilient locking nose 9 which coacts with the lower surface of the base 1 to lock the pan 4 removably. Moreover, the same projection 8 comprises a nose 10 coacting with the nose 11 of the cover 2 for opening and locking the compact.

We claim:

1. Compact comprising a base (1) having an edge and a cover (2) articulated to each other by means of a hinge (3), catch means (10,11) for the base (1) relative to the cover (2) opposite said hinge (3), and an interchangeable pan (4) containing at least one makeup product (5) and disposed in said base (1), said compact base having a rear surface, two side surfaces and a forward surface, said forward surface having an opening over a portion of its length opposite said hinge (3) when said cover (2) is secured to said base (1) by said catch means (10,11), and said pan (4) comprising a forward portion (8), of a shape to substantially close the opening in said forward surface, said forward portion (8) projecting exteriorly of the compact through said opening of the forward surface of the compact to allow variously shaped pans to be interchanged and to substantially enclose said base thereby completing the compact.

2. Compact according to claim 1, wherein said forward portion (8) comprises a resilient locking nose (9) engaging with the edge of the base (1).

3. Compact according to claim 1, wherein said forward portion (8) has a nose (10) for locking with the cover (2).

4. Compact according to claim 1, comprising means for direct locking of the cover (2) on the base (1) with respective locking means passing through an opening provided in the forward portion (8) of the pan (4).

* * * * *